US005626040A

United States Patent [19]

Benavides

[11] Patent Number: 5,626,040

[45] Date of Patent: May 6, 1997

[54] ROTARY PIN-IN-MAZE DISCRIMINATOR

[75] Inventor: Gilbert L. Benavides, Albuquerque, N.M.

[73] Assignee: Sandia Corporation, Albuquerque, N.M.

[21] Appl. No.: 277,100

[22] Filed: Jul. 20, 1994

[51] Int. Cl.[6] ..... E05B 37/20

[52] U.S. Cl. ..... 70/290; 70/289

[58] Field of Search ..... 70/289, 290; 273/142 H, 273/153 S, 156

[56] References Cited

U.S. PATENT DOCUMENTS

| | | | |
|---|---|---|---|
| 8,396 | 9/1851 | Nicholson | 70/290 |
| 49,712 | 9/1865 | Bussey | 70/290 |
| 396,273 | 1/1889 | Douds | 70/290 |
| 615,381 | 12/1898 | Brockett | 70/290 |
| 660,295 | 10/1900 | Flinder . | |
| 744,884 | 11/1903 | Taylor | 273/156 |
| 766,118 | 7/1904 | Saunders | 273/156 |
| 785,132 | 3/1905 | Viewig | 70/290 |
| 851,575 | 4/1907 | Viewig | 70/290 |
| 914,819 | 3/1909 | Gagnon | 70/290 |
| 1,086,551 | 2/1914 | Mosher | 70/289 |
| 3,824,815 | 7/1974 | Darling | 70/290 |
| 5,259,619 | 11/1993 | Rosewarne | 273/153 R |

*Primary Examiner*—Steven N. Meyers
*Assistant Examiner*—Gary Estremsky
*Attorney, Agent, or Firm*—Gregory A. Cone

[57] ABSTRACT

A discriminator apparatus and method that discriminates between a unique signal and any other (incorrect) signal. The unique signal is a sequence of events; each event can assume one of two possible event states. Given the unique signal, a maze wheel is allowed to rotate fully in one direction. Given an incorrect signal, both the maze wheel and a pin wheel lock in position.

22 Claims, 3 Drawing Sheets

UQS: AAABBAABBBAAABBBAABABBAB

ROTARY PIN-IN-MAZE DISCRIMINATOR

GOVERNMENT RIGHTS

The Government has rights to this invention pursuant to Contract No. DE-AC04-76DP00789 awarded by the U.S. Department of Energy.

BACKGROUND OF THE INVENTION

1. Field of the Invention (Technical Field)

The invention relates to safety and security discriminators and more particularly to an apparatus and method for mechanically discriminating a unique signal utilizing a pin-in-maze structure.

2. Background Art

Discriminator devices are being proposed as safety devices in diverse areas such as automotive, aircraft, nuclear reactors, chemical processing plants and robotic handling of hazardous/radioactive material. Discriminator devices also have security applications and can be used to deny access to those not having the unique signal.

The pin-in-maze discriminator of the present invention was developed as a safety component to prevent the occurrence of catastrophic accidents. Accidents involving nuclear power plants, chemical processing plants, and airplane crashes are examples of catastrophes. These accidents are due to the failure of human made machines and are not natural disasters in themselves. Abnormal occurrences can lead to catastrophic accidents which result in great loss of life and resources. The ability to predict the response of abnormal occurrences acting on the machine is a major step toward preventing catastrophes. Simply stated, machine components that fail predictably, can prevent little accidents from becoming big accidents.

Prior maze-type locking devices, including U.S. Pat. No. 396,273, to Douds, U.S. Pat. No. 660,295, to Flinder, U.S. Pat. No. 3,824,815, to Darling, and U.S. Pat. No. 5,259,619, to Rosewarne, differ from the present invention in significant ways that reduce their utility vis-a-vis the present invention. These patents are incorporated herein by reference in their entirety. For example, the present invention: (1) provides an independently rotating pin wheel; (2) provides a single correct path defined by binary mechanical events; (3) provides an optional hold pawl to lock the device on the occurrence of an incorrect event; and (4) provides a fail-safe feature to prevent triggering of the locked device in the event of pin fracture.

SUMMARY OF THE INVENTION (DISCLOSURE OF THE INVENTION)

The present invention is of a discriminator apparatus and a discriminating method comprising: providing a first surface capable of rotation; providing a second surface capable of rotation; placing on the first surface a maze comprising a plurality of decision points, each decision point comprising two advancement choices, one of which leads to a dead end in the maze; and securing an extended member to the second surface, the extended member being capable of engaging and passing through the maze.

In the preferred embodiment, the invention additionally comprises locking the surfaces against further rotation in the event the extended member enters one of the dead ends, such as by preventing rotation of the first surface in one direction by ratchet means engaging the first surface, such as hold pawl means. The maze may be approximately circular, the extended member be a pin, and the first surface and the second surface rotate alternately. Preferably, egress of the extended member from an exit of the maze is detected.

A primary object of the present invention is to provide a discriminator mechanism providing a high degree of safety to the devices on which it is engaged.

A primary advantage of the present invention is that provides a single correct path through the discriminator based on binary events.

Another advantage of the present invention is that a fail-safe feature is provided to prevent triggering the engaged device in the event of pin fracture.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

The present invention is of a rotary pin-in-maze discriminator and method for discrimination of valid coded attempts to open a locking device. The primary purpose of the invention is to reduce the risk of a catastrophe triggered by accidental events as much as possible.

Figure 1:
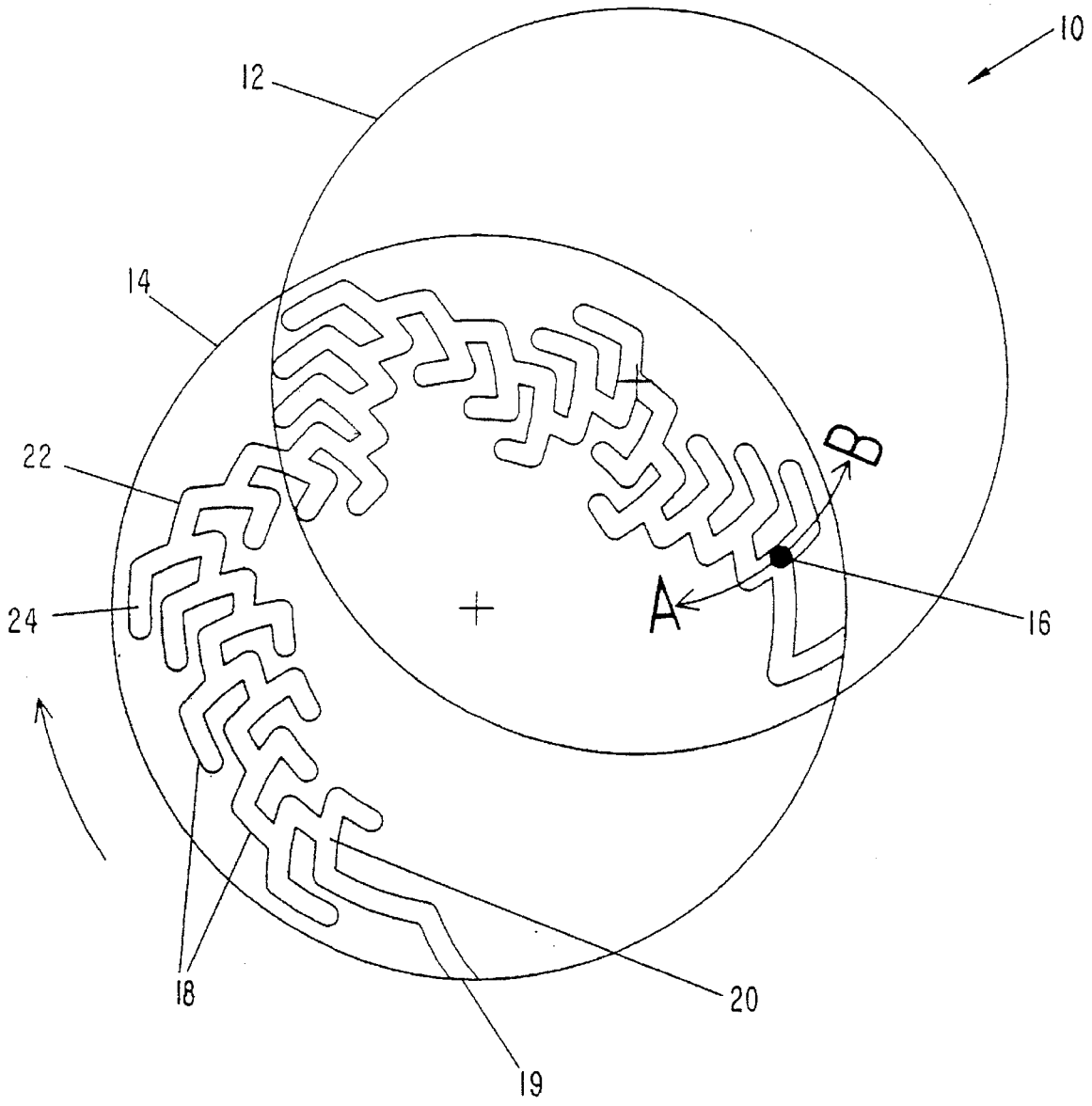
FIG. 1 schematically illustrates the preferred embodiment of the pin wheel and the maze wheel.

Referring to FIG. 1, the present invention 10 consists of two major parts, a pin wheel 12 and a maze wheel 14. An optional ratchet mechanism (not shown) can be used to prevent maze wheel 14 from rotating counterclockwise. The pin-in-maze mechanism can be operated by two actuators. One actuator could be capable of rotating the pin wheel either clockwise or counterclockwise, and the other actuator could be capable of rotating the maze wheel clockwise.

A cylindrical pin 16 is fixed perpendicular to the face of the pin wheel 12 at a particular radius. The subsurface maze pattern 18 is created below a face of the maze wheel 14 by an operation such as machining or molding. The maze width is slightly larger than the pin diameter. The gating portion 20 of the maze, which allows for the rotation of the pin wheel 12, has a nominal radius about equal to the radial placement of the pin 16 from the center of the pin wheel 12. Radii having centers which coincide at the maze wheel's axis of rotation define the advancement portion 22 of the maze which allows the maze wheel 14 to advance clockwise. The walls of the maze 18 are preferably perpendicular to the face of the maze wheel 14.

When assembled, the pin wheel's axis of rotation will pass through the center of the nominal radius of the gating portion 20 in the maze wheel 14 when the pin 16 is engaged in such portion of the maze. This axis of rotation is perpendicular to the face of the maze wheel 14 and parallel to the maze wheel's axis of rotation.

The rotational motion of either wheel is a discrete step which ceases upon either impacting the maze wall 24 or positioning the pin 16 so that the motion of the other wheel can commence. The pin wheel 12 and maze wheel 14 alternate in motion. The non-actuated wheel remains stationary while the other wheel is actuated. If the pin 16 impacts the maze wall, the impact force normal to the common tangent plane of the impacting bodies passes through the axis of rotation of the stationary wheel. Consequently, the impact force does not give rise to a torque on the stationary wheel.

Given the unique signal, the pin 16 successfully advances through the maze 18, and exits through exit path 19. Given an incorrect signal, the pin 16 reaches a dead end path (e.g., maze wall 24) which locks the entire mechanism (i.e., both pin wheel 12 and maze wheel 14 are locked and cannot rotate), unless the maze wheel is allowed to rotate counterclockwise.

The particular unique signal defined by maze pattern 18 shown in FIG. 1 is 24 event occurrences long, each event being an "A" event (clockwise rotation of pin wheel 12) or a "B" event (counterclockwise rotation of pin wheel 12). Another unique signal pattern, which could be longer or shorter, could have been chosen. The event choices are binary, i.e., limited to two; one event choice requires a clockwise rotation of the pin wheel 12 and the other event choice requires a counterclockwise rotation of the pin wheel 12. The particular sequence of events can be different than the sequence shown in FIG. 1. The maximum number of event occurrences is only limited by the space available on the maze wheel 14. The discrete rotational step size for either wheel of the mechanism shown in FIG. 1 is an angular displacement of ten degrees. Given a step of ten degrees for the maze wheel 14, the ratchet teeth (if a ratchet mechanism was used) would also be spaced by ten degrees around the perimeter of the maze wheel 14.

The discriminator mechanism 10 in FIG. 1 is shown in the starting position. To execute the first event of the unique signal from this starting position, the pin wheel 12 must rotate clockwise by ten degrees and virtually come to rest prior to advancing the maze wheel 14 clockwise by ten degrees. The second event, which also involves a clockwise rotation of the pin wheel 12, occurs after the maze wheel 14 has virtually come to rest. Only if this sequence of events occurs according to the unique signal will the maze wheel 14 rotate freely past all event occurrences. If the signal is incorrect the pin 16 will be trapped in one of the maze's dead ends 24.

Figure 2A:
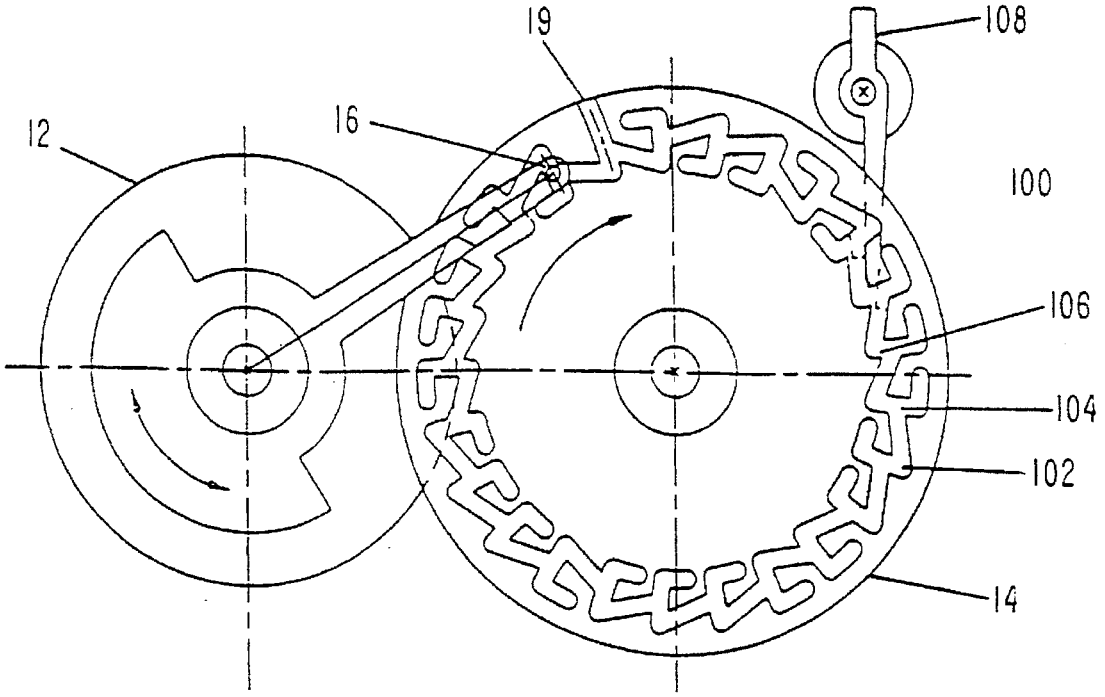
FIG. 2 illustrates the alternative 3-track pin-in-maze embodiment.
Figure 2B:
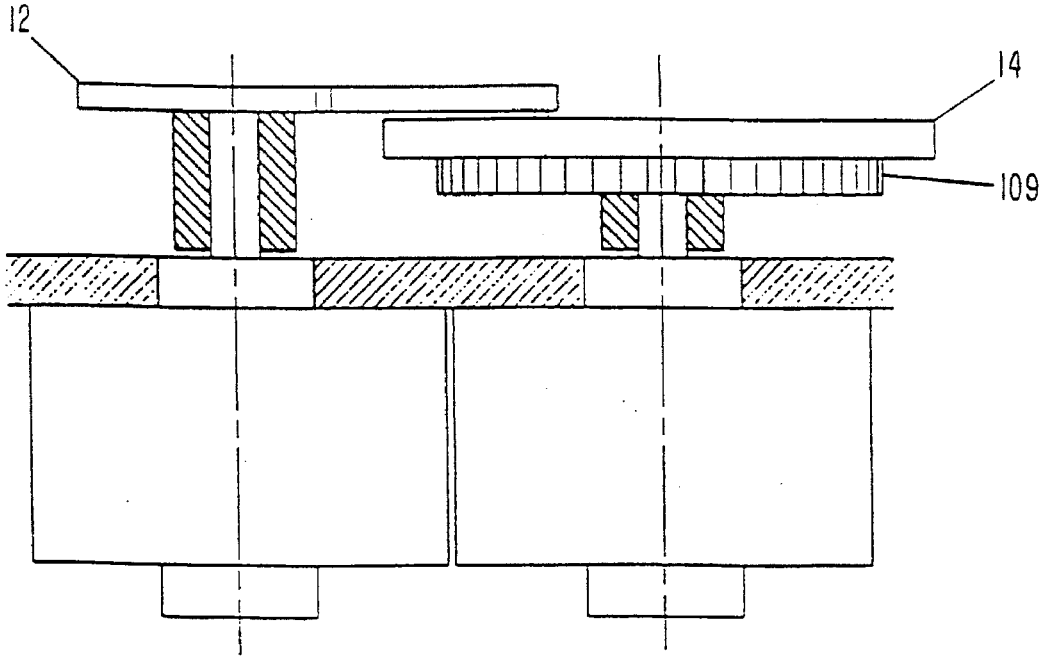

An alternate embodiment of the invention is shown in FIG. 2. This 3 track pin-in-maze 100 is so named because there are three designated pin wheel dwelling tracks 102, 104, and 106 radially spaced on the maze wheel 14. Also shown in FIG. 2 is an optional ratchet mechanism (in this case ratchet teeth 109 and hold pawl 108) to prevent counterclockwise rotation of the maze wheel 14. An event is executed by either a clockwise or counterclockwise rotation of fixed displacement of the pin wheel 12 followed by a fixed clockwise rotation of the maze wheel 14. In this configuration, the pin wheel 12 is returned to the center track 104 upon the rotational advancement of the maze wheel 14. A major advantage of this configuration is that the diameter of the maze wheel 14 may be smaller for some unique signal patterns.

Figure 3:
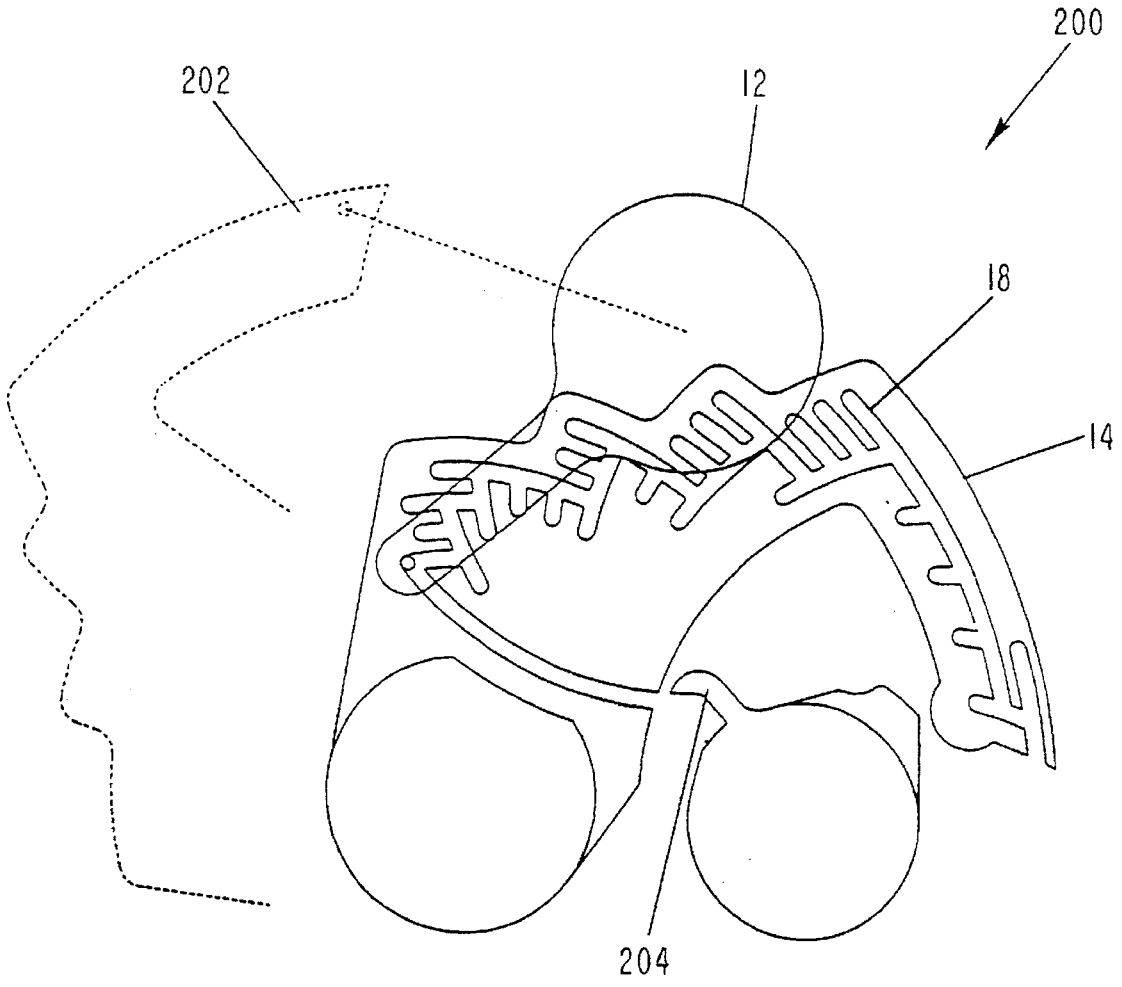
FIG. 3 illustrates the alternative single action pin-in-maze embodiment.

An additional embodiment is illustrated in FIG. 3. This single action pin-in-maze 200 does not require a pin wheel gating action prior to maze wheel advancement to complete an event. The two previous pin-in-maze mechanisms do require a gating action. The single action pin-in-maze is so named because only one action from either the pin wheel 12 or the maze wheel 14 is required to complete an event. Thus, the maze wheel 14 can be the "A" event wheel and the pin wheel 12 can be the "B" event wheel. There are at least two advantages to the single action pin-in-maze configuration 200. First, it is possible to execute the unique signal much more rapidly because only one wheel motion is required per event (the previous mechanisms required both wheels to rotate per event). Second, it is possible to operate this mechanism with only one bi-directional actuator. For example, a ratcheting mechanism could be used to route the actuator's clockwise motion to the maze wheel 14 and counterclockwise motion to the pin wheel 12.

FIG. 3 shows maze wheel 14 in its ending position upon receipt of the proper unique coded signal. (Starting position 202 is shown in dotted lines). Pin wheel 12 is ready to rotate out of maze 18 to engage pin detector 204 (for example a coupler or critical constituent). The purpose of pin detector 204, which can be used with any embodiment of the invention, is to ensure that progress through maze 18 did not occur due to pin shearing or fracture. Thus, pin detector 204 provides an additional fail safe protection for the system.

Inspection of FIGS. 1, 2 and 3 shows that the angular displacements of the 'A' and 'B' event movements remain constant as the pin 12 negotiates the decision points in the maze pattern 18. In FIGS. 1 and 2, only the pin wheel 12 makes the decision movements, and the movements are of equal angular displacement. In FIG. 3, both wheels make decision movements. In this case, the movements are of constant angular displacement, but the angular displacement of the pin wheel 12 is not necessarily the same as the angular displacement of the maze wheel 14 as they make their respective 'A' and 'B' decision movements.

The pin-in-maze discriminator mechanism was developed as a safety component in support of a safety theme described as safety through predictability. Unlike other safety methods, such as safety through reliability or safety through protection, safety through predictability is a method to prevent the catastrophic accident from ever occurring. Catastrophic accidents often circumvent the option of safety through protection. Accidents involving nuclear power plant, chemical processing plant, and airplane crashes are examples of catastrophes. These are accidents due to the failure of human made machines and are not natural disasters in themselves. Abnormal occurrences can lead to catastrophic accidents which result in great loss of life and resources. The ability to predict the response of abnormal occurrences acting on the machine is a major step towards preventing catastrophes. Simply stated, machine components that fail predictably, can prevent little accidents from becoming big accidents.

Abnormal occurrences can be abnormal environments such as mechanical shock, lightning, fire or other unintended actions such as operator error. Abnormal environments are those that are not normal and normal environments are those that the machine must operate within.

There is an identifiable sequence of processes that culminate in an accident. The constituents that allow these processes to occur are called critical constituents. Critical constituents necessary to sustain an accident are enlisted to avert the accident by applying safety principles. The safety of each accident scenario is assured by at least one of the following three safety principles:

Inoperability (fuses)

Isolation (barriers)

Incompatibility (the unique signal).

A rugged component comprised of a discriminator, a critical constituent and an enabling device, works in conjunction with the fuses to create the backbone of the safety theme. The rugged component has three major functions. First, to provide isolation of a critical constituent until the unique signal (UQS) is received. Second, to discriminate the UQS and reject all other signals. Third, to remain safe until failure of the fuses in an abnormal environment. The rugged component isolates a critical constituent by physically removing and locking the constituent away from the vulnerable position and also by surrounding it with a strong barrier. The critical constituent internal to the rugged component is called a coupler. The fuses are critical constituents that fail predictably in an abnormal environment. Once the critical constituents irreversibly fail, the machine is retained safe and the inoperability safety principle is satisfied. Thus, a fuse must be identified for every credible abnormal environment. This concept can be expanded to include other abnormal occurrences such as operator error.

To perform certain machine functions, the coupler must be placed in the vulnerable enabling position. To enable the coupler, a communication channel must be established. Critical signals are transmitted through the communication channel to enable the coupler.

The safety of the critical signals is assured by the incompatibility principle of safety. The critical signals are communicated serially in a particular pattern known as the unique signal (UQS). The UQS is almost impossible to accidentally recreate in an abnormal environment. Each event must be one of two types, an A event type or a B event type. An example of a unique signal encompassing twenty-four binary events is as follows:

AAABBAABBBAAABBBAABABBAB

It is important to note that a technology was developed to identify acceptable unique signals to minimize the probability of accidental recreation. A random pattern in itself is unsatisfactory.

The unique signal is manifested as energy (e.g. electrical) along the communication channel that must adhere to format requirements for an A type event and a B type event. The unique signal is translated to mechanical events in the rugged component through a mechanism called a discriminator. The discriminator will allow enablement of the coupler (i.e. to place the critical constituent in the unsafe position) upon receiving the correct UQS and to lockup upon receiving any other signal. The mechanical aspect of the discriminator allows it to fail predictably in an abnormal environment. The implementation of the correct UQS demonstrates intent to enable the coupler. The UQS cannot be stored in the machine because this would defeat the incompatibility safety principle. Rather, the UQS is concatenation of normal occurrences. These normal occurrences can be detected by environmental sensing devices or as input from the human/machine interface.

The present invention, in its various embodiments, provides a discriminator for the above uses that is both rugged and highly fail safe.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. A discriminator apparatus comprising:

a first planar surface capable of rotation;

a second planar surface capable of rotation, said first and second surfaces having parallel but separate axes of rotation;

a maze consisting of a plurality of binary decision points, each decision point comprising two advancement choices of constant angular displacement, one of which leads to a dead end in said maze, said maze being placed on said first surface; and an extended member fixed to and extending perpendicularly from said second surface, said extended member being capable of engaging and passing through said maze.

2. The apparatus of claim 1 additionally comprising means for locking said surfaces against further rotation in the event said extended member enters one of said dead ends.

3. The apparatus of claim 2 wherein said means for locking comprises means for preventing rotation of said first surface in one direction.

4. The apparatus of claim 3 wherein said means for preventing rotation comprises ratchet means.

5. The apparatus of claim 4 wherein said ratchet means comprises hold pawl means.

6. The apparatus of claim 1 wherein said extended member comprises a pin.

7. The apparatus of claim 1 wherein said maze is approximately circular.

8. The apparatus of claim 1 wherein said first surface and said second surface rotate alternately.

9. The apparatus of claim 1 additionally comprising means for detecting egress of said extended member from an exit of said maze.

10. A discriminating method comprising the steps of:

providing a first planar surface capable of rotation;

providing a second planar surface capable of rotation, said first and second surfaces having parallel but separate axes of rotation;

placing on the first surface a maze consisting of a plurality of binary decision points, each decision point comprising two advancement choices of constant angular displacement, one of which leads to a dead end in the maze; and securing an extended member to the second surface that extends perpendicularly therefrom, the extended member being capable of engaging and passing through the maze.

11. The method of claim 10 additionally comprising the step of locking the surfaces against further rotation in the event the extended member enters one of the dead ends.

12. The method of claim 11 wherein the locking step comprises preventing rotation of the first surface in one direction.

13. The method of claim 12 wherein preventing rotation comprises providing ratchet means engaging the first surface.

14. The method of claim 13 wherein the step of providing ratchet means comprises providing hold pawl means.

15. The method of claim 10 wherein the securing step comprises securing a pin.

16. The method of claim 10 wherein the placing step comprises placing a maze which is approximately circular.

17. The method of claim 10 additionally comprising the step of alternately rotating the first surface and the second surface.

18. The method of claim 10 additionally comprising the step of detecting egress of the extended member from an exit of the maze.

19. The apparatus of claim 1 further comprising an external arm disposed so as to be engaged by the extended member when it exits the maze.

20. The apparatus of claim 1 wherein the extended member is frangible to the extent that it will break if forced past a dead end.

21. The apparatus of claim 1 wherein the first surface is restricted to move only in one direction.

22. The apparatus of claim 1 wherein the constant displacement is equal angular displacement.

* * * * *